US012721461B1

(12) United States Patent
Krishnan

(10) Patent No.: US 12,721,461 B1
(45) Date of Patent: Sep. 1, 2026

(54) GLOVE REMOVAL DEVICE

(71) Applicant: Maya Murali Krishnan, San Diego, CA (US)

(72) Inventor: Maya Murali Krishnan, San Diego, CA (US)

( * ) Notice: Subject to any disclaimer, the term of this patent is extended or adjusted under 35 U.S.C. 154(b) by 0 days.

(21) Appl. No.: 19/022,004

(22) Filed: Jan. 15, 2025

(51) Int. Cl.
*A47G 25/90* (2006.01)

(52) U.S. Cl.
CPC ..... *A47G 25/904* (2013.01)

(58) Field of Classification Search
CPC ..... A47G 25/90; A47G 25/904; A47G 25/92
See application file for complete search history.

(56) References Cited

U.S. PATENT DOCUMENTS 6,021,935 A * 2/2000 Yonezawa ..... A47G 25/904 223/111
10,034,566 B1 * 7/2018 Shin ..... A61B 50/30
10,420,621 B1 * 9/2019 Binder ..... A61B 42/40
2007/0170213 A1 * 7/2007 Gaines ..... A61B 42/40 223/111

FOREIGN PATENT DOCUMENTS

BR 112019003696 B1 * 11/2022 ..... B29D 99/0067
FR 2614517 A1 * 11/1988 ..... A47G 25/904

OTHER PUBLICATIONS

Translation FR 2614517.*
Translation BR 112019003696.*

* cited by examiner

*Primary Examiner* — Shaun R Hurley
(74) *Attorney, Agent, or Firm* — Plager Schack LLP; Mark H. Plager; Naomi Mann

(57) ABSTRACT

A glove removal system provides a glove removal device comprising a motorized and sensor actuated clamping system. The clamping system is configured to pinch a loosened tip end of a glove so that a user may pull his/her hand out of the glove without skin contact with the glove's exterior.

8 Claims, 3 Drawing Sheets

GLOVE REMOVAL DEVICE

BACKGROUND

The present disclosure relates generally to systems and methods for automated glove removal.

Removal of gloves after handling hazardous substances (e.g., toxic chemicals, biohazards, etc.) poses a risk of transferring the substance to the user's skin, as the handled substance may often contaminate the glove's exterior. As such, an improved glove removal system which avoids direct skin-contact is needed.

SUMMARY

According to various embodiments, disclosed is a glove removal device, which may comprise a first clamping member having a first clamping surface; a second clamping member having a second clamping surface opposite the first clamping surface; an actuator system configured to switch the first clamping member and the second clamping member between an open position and a clamping position via relative displacement of at least one of the first clamping member and the second clamping member; and a sensor actuated trigger system configured to trigger the actuator system in switching the first clamping member and the second clamping member from the open position to the clamping position upon detection of an object within a space between the first clamping surface and the second clamping surface, wherein in the clamping position, the first clamping member and the second clamping member are moved towards one another and are configured to clamp an object present within a pinch zone between the first and second clamping surfaces.

In some embodiments, the first clamping member comprises a pinch member having a terminal surface defining said first clamping surface and configured to press flatly against the second clamping surface of the second clamping member. In some embodiments, the first clamping member comprises a first plate incorporating said pinch member, said pinch member comprising a block having a flat terminal surface facing said second surface of the second clamping member, wherein the second clamping member comprises a second plate incorporating said second clamping surface. In some embodiments the first plate and second plate are horizontally oriented, wherein the actuator system is configured to move the first plate while the second plate remains stationary. In certain embodiments, the device further comprises a main support block; a stationary plate support assembly which is supported on the main support block and which supports the second clamping member in a vertically stationary position; and the actuator system comprises a motorized linear actuator which is supported on the main support block and is configured to support the first clamping member in a vertically movable position. In some embodiments the first clamping member is positioned above the second clamping member. In some embodiments the motorized linear actuator comprises a motor which is housed within the main support block. In some embodiments the sensor actuated trigger system comprises an emitter component coupled to one of the first clamping member or the second clamping member, and a receiver component coupled to the other one of the first clamping member or the second clamping member, the receiver component configured to detect a signal emitted from the emitter component, wherein said signal emitted from the emitter component is broken upon placement of an object within the space between the first clamping surface and the second clamping surface, and wherein the receiver component is configured to activate a motor of the motorized linear actuator upon detection that the signal from the emitter component is broken.

In further embodiments, disclosed is a glove removal method, which may comprise inserting a gloved hand into a glove removal device, wherein the gloved hand includes loosened glove material which is pulled away from a finger tip of the gloved hand. In some embodiments, the glove removal device comprises a first clamping member having a first clamping surface; a second clamping member having a second clamping surface opposite the first clamping surface; an actuator system configured to switch the first clamping member and the second clamping member between an open position and a clamping position via relative displacement of at least one of the first clamping member and the second clamping member; and a sensor actuated trigger system configured to trigger the actuator system in switching the first clamping member and the second clamping member from the open position to the clamping position upon detection of an object within a space between the first clamping surface and the second clamping surface, wherein in the clamping position, the first clamping member and the second clamping member are moved towards one another and are configured to clamp an object present within a pinch zone between the first and second clamping surfaces. In some embodiments, the glove removal device further comprises a main support block; a stationary plate support assembly which is supported on the main support block and which supports the second clamping member in a vertically stationary position; and the actuator system comprises a motorized linear actuator which is supported on the main support block and is configured to support the first clamping member in a vertically movable position.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
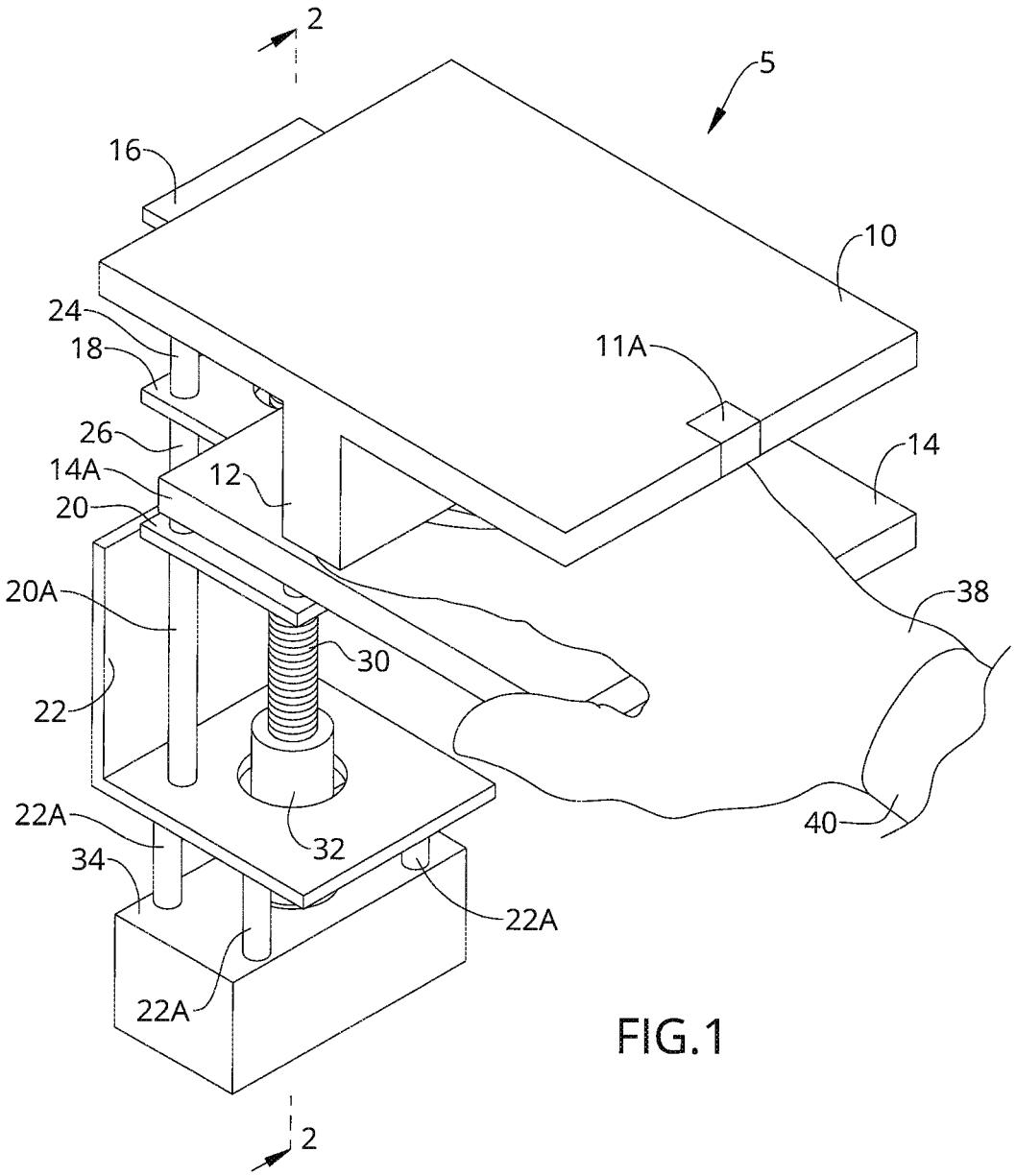
FIG. 1 is a perspective view of a glove removal device according to certain embodiments.
Figure 2:
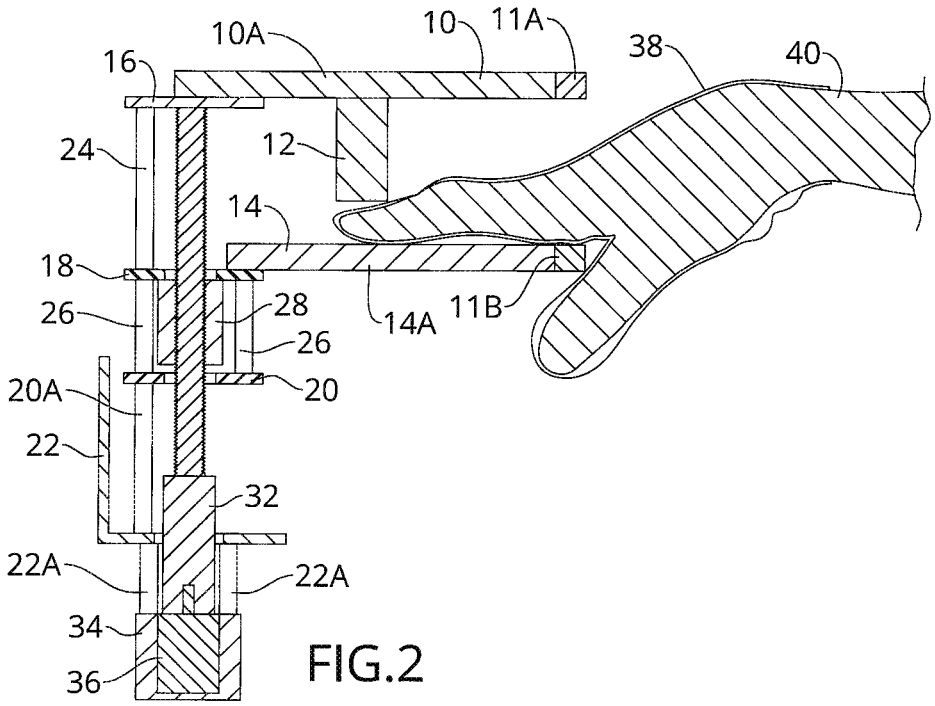
FIG. 2 is a section view taken along line 2-2 in FIG. 1.
Figure 3:
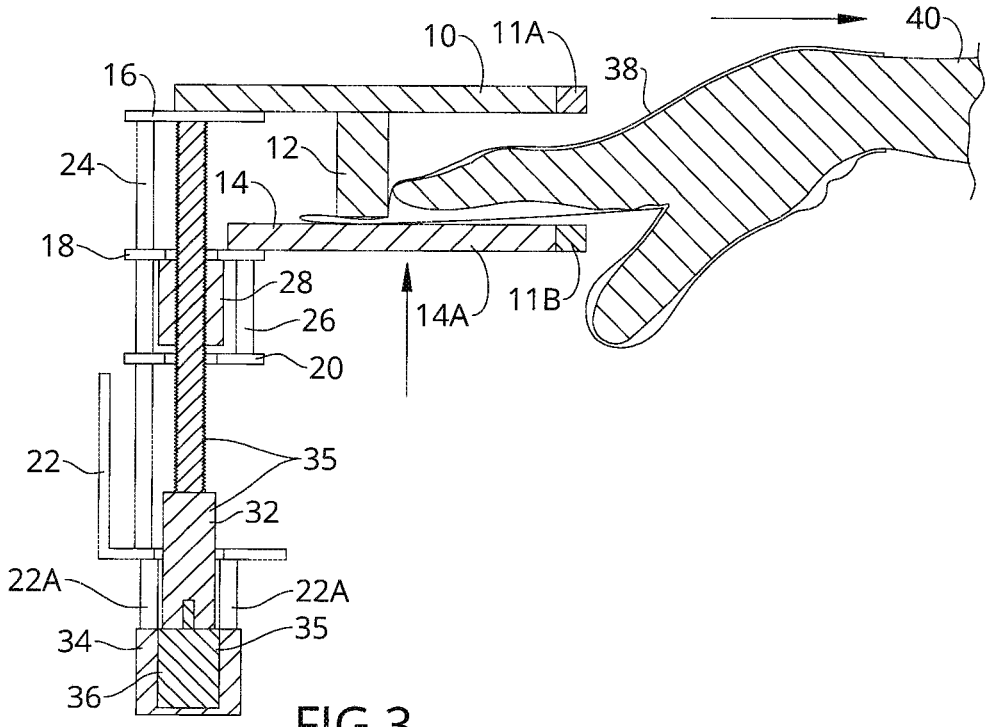
FIG. 3 is a section view showing closing motion of the glove removal device.
Figure 4:
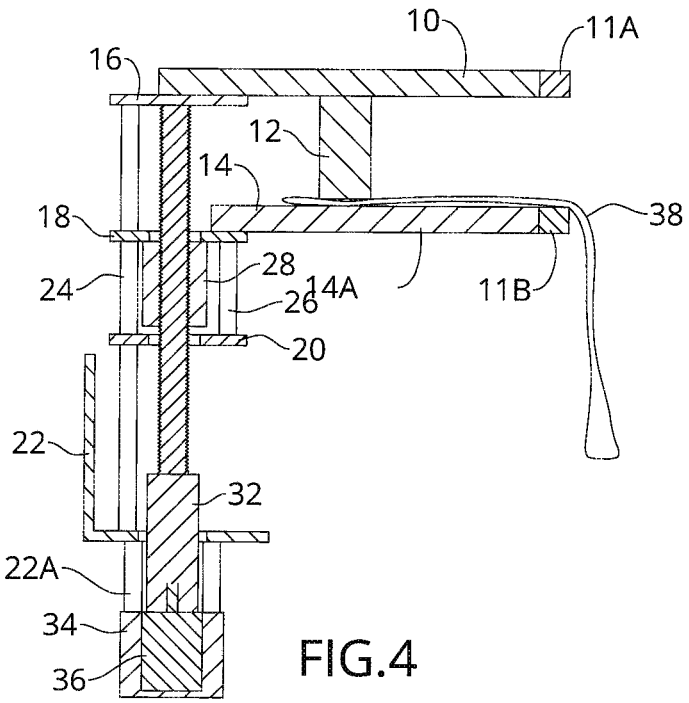
FIG. 4 is a section view illustrating removal of a glove from the hand of a user.
Figure 5:
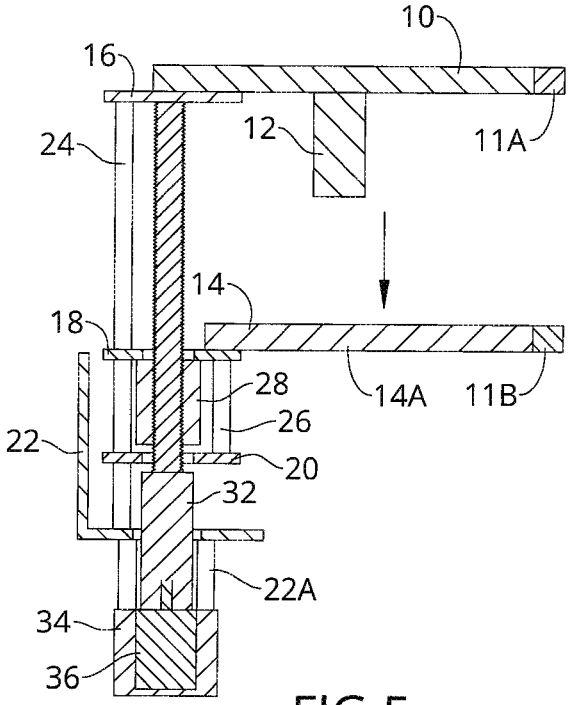
FIG. 5 is a section view showing opening motion of the glove removal device.

According to various embodiments as depicted in FIGS. 1-5, disclosed is a glove removal system/method which provides a glove removal device 5 comprising a motorized and sensor actuated clamping system. The clamping system is configured to pinch a loosened tip end of a glove 38 so that a user may pull his/her hand 40 out of the glove without skin contact with the glove's exterior. The disclosed system is ideal for removal of disposable gloves such as latex nitrile gloves, and the like, which may be used in hospitals, laboratories, food handling, etc.

In certain embodiments, glove removal device 5 comprises a first clamping member 10 and a second clamping member 14 which are configured to switch between an open position and a clamping position wherein the clamping members are moved towards one another for pinching an end of glove 38 within a clamping or pinch zone between the clamping members. In some embodiments, glove removal device 5 also comprises a sensor actuated trigger system which is configured to detect the presence of an object in a space between first and second clamping members 10, 14, and to move the clamping members from the open position to the clamping position upon said detection.

In certain embodiments first clamping member 10 may comprise a top horizontal plate 10A, and second clamping member 14 may comprise a bottom horizontal plate 14A which faces top horizontal plate 10A of first clamping member 10. First clamping member 10 may further include a pinch member 12 extending from top horizontal plate 10A towards bottom horizontal plate 14A. Pinch member 12 is configured to press against bottom horizontal plate 14A when first clamping member 10 and bottom horizontal plate 14A are moved towards one another. In one embodiment, pinch member 12 may be a block having a flat terminal or bottom surface such that it presses flatly against the inner surface of bottom horizontal plate 14A. This increases the surface area that presses against the loosened tip of the glove to increase the effective pinch force on the glove. In one embodiment, the bottom surface of pinch member 12 may have an area comparable to that of a flat fingertip of a glove, e.g., roughly about a square inch.

In certain embodiments, glove removal device 5 includes a main support block 34 which supports bottom horizontal plate 14A in a vertically stationary position via a stationary plate support assembly, and which further supports top horizontal plate 10A in a vertically movable position via a motorized linear actuator 35. According to an exemplary embodiment as depicted in the figures, the stationary plate support assembly for bottom horizontal plate 14A may include first support post(s) 22A supported on main support block 34, a first support bracket 22 supported on first support posts 22A, at least one second support post 20A supported on a horizontal plate of bracket 22, a second support bracket 20 supported atop second support post 20A, at least one and preferably two third support posts 26 supported atop second support bracket 20A, and a third support bracket 18 supported atop third support posts 26 and supporting bottom horizontal plate 14A. It shall be appreciated however, that different components and arrangement for supporting bottom horizontal plate 14A may be used in alternate embodiments.

In certain embodiments, motorized linear actuator 35 may comprise a motor 36 which may be protectively housed within main support block 34, and is in driving engagement with an actuator hub 32. Actuator hub 32 is in threaded engagement with threaded rod 30 which is coupled to a support plate 16 which supports top horizontal plate 10A of first clamping member 10. In some embodiments, threaded rod 30 may also be engaged through rotating hub 28. Additionally, through holes may be provided in support brackets 22, 20, and 18 for passage of actuator hub 32 and threaded rod 30, as depicted. In some embodiments, a stabilizing rod 24 may be provided atop the third support bracket 18 and is engaged through a hole in support plate 16 for stabilization. As such, rotation of motor 36 causes threaded rod 30 to translate vertically upwards or downwards depending on the direction of rotation to move top horizontal plate 10A for clamping or releasing glove 38.

In certain embodiments, a sensor actuated trigger system for activating motor 36 may comprise a laser or infrared break beam sensor, which may include an emitter component 11A coupled to one of the top or bottom horizontal plates 10A or 14A, and a receiver component 11B coupled to the other one of the top or bottom horizontal plates 10A, 14A and configured to detect a signal emitted from the emitter component. In one embodiment, emitter component 11A (e.g., a laser beam emitter) is provided on top horizontal plate 10A, and receiver component 11B (e.g., a laser beam receiver) is provided on bottom horizontal plate 14A opposite the emitter component 11A. Receiver component 11B is configured to send a signal to motor 36 of motorized linear actuator 35 to turn on the motor and cause clamping members 10, 14 to press together once the emitter signal is broken (i.e., no longer detected by receiver component 11B), and to move to a sustained open position once the signal is reinstated. In some embodiments, the system may incorporate a microprocessor for control logic in holding and releasing the clamping members back to original position.

As such, a user may remove glove 38 by pulling out the tip of the glove away from the fingers, then placing his/her hand in the space between top and bottom horizontal plates 10A, 14A, wherein the loosened glove material may be inserted under pinch member 12. This breaks the emitted signal from emitter component 11A and triggers motor 36 to turn on, causing top plate 10A to move downwards and squeeze against the loosened glove tip. The user may then pull his/her hand out of the glove, whereupon the clamping mechanism is released to allow the glove to fall into a trash can below. In some embodiments, the clamping members may automatically move to the open position after a predetermined time interval. Thus, glove removal device 5 allows for touchless glove removal to decrease the probability of contact with harmful substance that may be on the surface of the removed glove.

It shall be appreciated that the disclosed glove removal system and device may be used with different types of gloves, and in environments including hospital/health care facilities, laboratories (e.g., chemical, biochemical labs, and the like), food service facilities, animal care facilities, amongst others. Additionally, the disclosed system may be adapted for clamping different items in alternate embodiments. It shall be appreciated that the disclosed system and/or components of the disclosed system may have different configurations in alternate embodiments, and may be of any dimensions and/or geometric shapes. For example, second clamping member 14 may be configured to move towards first clamping member 10 and/or both clamping members may be configured to move towards one another in alternate embodiments. In some alternate embodiments, first and second clamping members may be vertically oriented, and/or need not necessarily have a plate form. Additionally, different components and arrangements for the stationary plate support assembly and the motorized linear actuator 35 may be used in alternate embodiments. In some embodiments, clamping members may be made of a plastic material, and may be manufactured via 3-D printing. It shall be appreciated however, that the components of the disclosed system may comprise any alternative known materials in the field and may be manufactured and assembled using any known techniques in the field.

It shall be understood that the orientation or positional relationship indicated by terms such as "upper", "lower", "front", "rear", "left", "right", "top", "bottom", "inside", "outside" is based on the orientation or positional relationship shown in the accompanying drawings, which is only for convenience and simplification of describing the disclosed subject matter, rather than indicating or implying that the indicated device or element must have a specific orientation or are constructed and operated in a specific orientation, and therefore should not be construed as a limitation of the present invention.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A glove removal device, comprising:

a first clamping member having a first clamping surface;

a second clamping member having a second clamping surface opposite the first clamping surface;

an actuator system configured to switch the first clamping member and the second clamping member between an open position and a clamping position via relative displacement of at least one of the first clamping member and the second clamping member; and a sensor actuated trigger system configured to trigger the actuator system in switching the first clamping member and the second clamping member from the open position to the clamping position upon detection of an object within a space between the first clamping surface and the second clamping surface, wherein in the clamping position, the first clamping member and the second clamping member are moved towards one another and are configured to clamp an object present within a pinch zone between the first and second clamping surfaces, wherein the first clamping member comprises a pinch member having a terminal surface defining said first clamping surface and configured to press flatly against the second clamping surface of the second clamping member.

2. The glove removal device of claim 1, wherein the first clamping member comprises a first plate incorporating said pinch member, said pinch member comprising a block having a flat terminal surface facing said second surface of the second clamping member, wherein the second clamping member comprises a second plate incorporating said second clamping surface.

3. The glove removal device of claim 2, wherein the first plate and second plate are horizontally oriented, wherein the actuator system is configured to move the first plate while the second plate remains stationary.

4. A glove removal device, comprising:

a first clamping member having a first clamping surface;

a second clamping member having a second clamping surface opposite the first clamping surface;

an actuator system configured to switch the first clamping member and the second clamping member between an open position and a clamping position via relative displacement of at least one of the first clamping member and the second clamping member;

a sensor actuated trigger system configured to trigger the actuator system in switching the first clamping member and the second clamping member from the open position to the clamping position upon detection of an object within a space between the first clamping surface and the second clamping surface;

a main support block; and a stationary plate support assembly which is supported on the main support block and which supports the second clamping member in a vertically stationary position, wherein in the clamping position, the first clamping member and the second clamping member are moved towards one another and are configured to clamp an object present within a pinch zone between the first and second clamping surfaces, and wherein the actuator system comprises a motorized linear actuator which is supported on the main support block and is configured to support the first clamping member in a vertically movable position.

5. The glove removal device of claim 4, wherein the first clamping member is positioned above the second clamping member.

6. The glove removal device of claim 4, wherein the motorized linear actuator comprises a motor which is housed within the main support block.

7. The glove removal device of claim 4, wherein the sensor actuated trigger system comprises an emitter component coupled to one of the first clamping member or the second clamping member, and a receiver component coupled to the other one of the first clamping member or the second clamping member, the receiver component configured to detect a signal emitted from the emitter component, wherein said signal emitted from the emitter component is broken upon placement of an object within the space between the first clamping surface and the second clamping surface, and wherein the receiver component is configured to activate a motor of the motorized linear actuator upon detection that the signal from the emitter component is broken.

8. A glove removal method, comprising:

inserting a gloved hand into a glove removal device, wherein the gloved hand includes loosened glove material which is pulled away from a finger tip of the gloved hand;

wherein the glove removal device comprises a first clamping member having a first clamping surface;

a second clamping member having a second clamping surface opposite the first clamping surface;

an actuator system configured to switch the first clamping member and the second clamping member between an open position and a clamping position via relative displacement of at least one of the first clamping member and the second clamping member;

a sensor-actuated trigger system configured to trigger the actuator system in switching the first clamping member and the second clamping member from the open position to the clamping position upon detection of an object within a space between the first clamping surface and the second clamping surface;

a main support block; and a stationary plate support assembly which is supported on the main support block and which supports the second clamping member in a vertically stationary position, wherein in the clamping position, the first clamping member and the second clamping member are moved towards one another and are configured to clamp an object present within a pinch zone between the first and second clamping surfaces, and wherein the actuator system comprises a motorized linear actuator which is supported on the main support block and is configured to support the first clamping member in a vertically movable position.

* * * * *